US009357852B2

(12) United States Patent
Salazar et al.

(10) Patent No.: US 9,357,852 B2
(45) Date of Patent: Jun. 7, 2016

(54) INFANT CARRIER WITH EXPANDABLE SEAT

(71) Applicant: INFANTINO, LLC, San Diego, CA (US)

(72) Inventors: Maureen O'Connor Salazar, Chicago, IL (US); Stacy Alycia Thomas Castro, Chicago, IL (US)

(73) Assignee: BLUE BOX OPCO LLC, San Diego, CA (US)

( * ) Notice: Subject to any disclaimer, the term of this patent is extended or adjusted under 35 U.S.C. 154(b) by 0 days.

(21) Appl. No.: 14/315,817

(22) Filed: Jun. 26, 2014

(65) Prior Publication Data

US 2015/0374139 A1 Dec. 31, 2015

(51) Int. Cl.
*A47D 13/02* (2006.01)

(52) U.S. Cl.
CPC ..... *A47D 13/025* (2013.01); *A47D 13/02* (2013.01)

(58) Field of Classification Search
CPC ..... A47D 13/025
USPC ..... 224/158–160; D3/214
See application file for complete search history.

(56) References Cited

U.S. PATENT DOCUMENTS 4,434,920 A * 3/1984 Moore ..... 224/160
4,492,326 A * 1/1985 Storm ..... 224/160
4,579,264 A * 4/1986 Napolitano ..... A47D 13/025 224/158
7,252,214 B2 * 8/2007 Krogh ..... 224/160
7,766,199 B1 8/2010 Caperon
D655,495 S * 3/2012 Sauer et al. ..... D3/214
8,172,116 B1 * 5/2012 Lehan et al. ..... 224/160
8,272,546 B2 * 9/2012 Leistensnider ..... 224/158
8,424,732 B1 * 4/2013 Lehan et al. ..... 224/160
8,453,894 B2 * 6/2013 Jung et al. ..... 224/160
D692,227 S * 10/2013 Andren ..... D3/213
8,636,181 B2 * 1/2014 Gunter et al. ..... 224/160
8,701,949 B1 * 4/2014 Lehan et al. ..... 224/160
8,752,739 B2 * 6/2014 Bergkvist et al. ..... 224/160
2010/0308088 A1 * 12/2010 Lindblom ..... 224/160
2012/0298702 A1 * 11/2012 Jung et al. ..... 224/158
2014/0263491 A1 * 9/2014 Telford et al. ..... 224/160
2014/0319189 A1 * 10/2014 Hoppener-Visser ..... 224/160

FOREIGN PATENT DOCUMENTS

DE 202014100616 U1 * 6/2014
DE 102012111052 B4 * 5/2015
EP 2194817 B1 * 11/2014
EP 2810587 A1 * 12/2014

* cited by examiner

*Primary Examiner* — Justin Larson
(74) *Attorney, Agent, or Firm* — Stetina Brunda Garred & Brucker

(57) ABSTRACT

An adjustable infant carrier includes a waist belt disposable about the waist of the wearer. A pair of shoulder straps is coupled to the waist belt, wherein each shoulder strap includes a free end portion and an opposed proximal end portion coupled to the waist belt. A carrier body is coupled to the waist belt and is connectable to the shoulder straps. The carrier body includes a middle section and a pair of conversion flaps disposed on opposed sides of the middle section. Each conversion flap is selectively transitional between a narrow configuration, wherein a free end portion of the conversion flap is connected to the middle section, and a wide configuration, wherein the free end portion of the conversion flap is connected to the waist belt.

18 Claims, 4 Drawing Sheets

INFANT CARRIER WITH EXPANDABLE SEAT

CROSS-REFERENCE TO RELATED APPLICATIONS

Not Applicable

STATEMENT RE: FEDERALLY SPONSORED RESEARCH/DEVELOPMENT

Not Applicable

BACKGROUND OF THE INVENTION

1. Technical Field of the Invention

The present disclosure generally relates to an infant carrier, and more specifically to an infant carrier having an adjustable seat and a shoulder strap system which may be secured to the wearer prior to placing the infant in the carrier.

2. Description of the Related Art

It is common practice for parents and other caregivers to carry infants and toddlers, and there is a variety of well-known devices suitable to this end. Such infant-carrying devices include carriages, strollers, pushchairs, and car seats, which are separate units particularly configured for holding the infant or toddler independent of the parent/caregiver adult. The adult, in turn, holds and transports the device with handles and other attachments thereof.

Alternatively, there are devices known in the art configured to be worn by the adult for on-the-body carrying of the infant or toddler, including slings, wraps, pouches, and backpack-like shoulder strap devices. Shoulder-supported infant carriers are particularly growing in popularity for supporting or transporting an infant or young child. A common attribute of these carriers is that they typically offer "hands free" operation, and allow the adult wearer to carry the infant while performing other activities. Therefore, shoulder-supported infant carriers typically provide immediate benefits to the parent/caregiver, including the freedom to use both hands while monitoring and caring for the child being carried. Care may be provided to other children simultaneously, strain and fatigue on the arms, back, and shoulders may be reduced, and household chores may be completed while monitoring the child. Moreover, cumbersome and bulky strollers need not be deployed in potentially dangerous places, such as crowded city sidewalks and public transportation systems.

Shoulder supported infant carriers, as currently known in the art, come in a wide range of designs and styles. One currently known infant carrier is a frame-type carrier which typically supports the infant on the back of the wearer. Currently, more popular than frame-type carriers, are frameless or soft-sided carriers which typically provide more comfort to the wearer and the infant.

Although soft-sided carriers have become a popular means for transporting an infant, most soft-sided carriers suffer from one or more drawbacks. For instance, one common drawback associated with conventional soft-sided carriers is that they are configured in a manner which requires the carrier to be placed on the wearer at the same time the infant is placed in the carrier. In this regard, the user is typically required to hold the infant with one hand, while placing the shoulder straps over the wearer's shoulders and guiding the infant carrier around the infant with the other hand. This practice tends to be very difficult and unsafe, as it may require a great deal of coordination on the part of the wearer and the infant.

Another drawback associated with many conventional soft-sided carriers is that the seat portion of the carrier is of a fixed size. Therefore, as the infant grows, the seat portion of the carrier may become too small, or when the infant is young, the seat portion of the carrier may be configured to support a larger infant, and thus, may be too big. Furthermore, the fixed nature of the seat portion on conventional infant carriers may limit the adaptability achievable by the infant carriers, i.e., the infant carrier may not be easily or comfortably adaptable in both front carry and rear carry configurations.

Accordingly, there is a need in the art for an infant carrier that is configured to allow the carrier to be secured to the wearer's shoulders before the infant is placed therein. There is also a need in the art for an infant carrier having an adjustable seat portion which supports the infant. Various aspects of the present invention are directed toward addressing these needs, as will be discussed in more detail below.

BRIEF SUMMARY OF THE INVENTION

Various aspects of the present invention are directed toward an adjustable infant carrier specifically configured and adapted to provide a safer and adaptable infant carrying device. In particular, the infant carrier may include a seat portion that is selectively transitional between a narrow seat configuration and a wide seat configuration so as to accommodate children of differing size, as well as different support positions/configurations. The infant carrier may additionally be configured to allow the wearer to securely fasten the infant carrier to his/her body before placing the infant therein. Thus, the wearer may focus first on ensuring that the carrier is properly fitted on his/her body, and then focus on placing the infant within the carrier, rather than having to perform both tasks simultaneously, as is the case in many conventional infant carrier devices.

According to one embodiment, the adjustable infant carrier includes a waist belt disposable about the waist of the wearer. A pair of shoulder straps is coupled to the waist belt, wherein each shoulder strap includes a free end portion and an opposed proximal end portion coupled to the waist belt. A carrier body is coupled to the waist belt and is connectable to the shoulder straps. The carrier body includes a middle section and a pair of conversion flaps disposed on opposed sides of the middle section. Each conversion flap is selectively transitional between a narrow configuration, wherein a free end portion of the conversion flap is connected to the middle section, and a wide configuration, wherein the free end portion of the conversion flap is connected to the waist belt.

The infant carrier may include a pair of carrier body fasteners coupled to the carrier body, a pair of waist belt fasteners coupled to the waist belt, and a pair of slots formed in respective ones of the pair of conversion flaps. The pair of slots may be configured to receive respective ones of the pair of carrier body fasteners when the conversion flaps are in the narrow configuration, and the pair of slots may be configured to receive respective ones of the pair of waist belt fasteners when the conversion flaps are in the wide configuration.

The infant carrier may be configured to be wearable in any one of three discrete front carry configurations, wherein the infant is supported over the wearer's chest and a back carry configuration, wherein the infant is supported over the wearer's back.

The infant carrier may include a pair of adjustment straps, wherein each adjustment strap is coupled to and extends between a respective shoulder strap free end portion and the carrier body. The infant carrier may further include a pair of elastic straps, with each elastic strap extending between a respective adjustment strap and a middle section of a respective shoulder strap.

The carrier body may be pivotally coupled to the waist belt and transitional between an upper configuration and a lower configuration relative to the waist belt when the waist belt and shoulder straps are worn by the wearer, wherein the degree of overlap between the carrier body and waist belt increases as the carrier body transitions from the upper configuration to the lower configuration.

The presently contemplated embodiments will be best understood by reference to the following detailed description when read in conjunction with the accompanying drawings.

BRIEF DESCRIPTION OF THE DRAWINGS

These and other features and advantages of the various embodiments disclosed herein will be better understood with respect to the following description and drawings, in which.

Common reference numerals are used throughout the drawings and the detailed description to indicate the same elements.

DETAILED DESCRIPTION OF THE INVENTION

Figure 1:
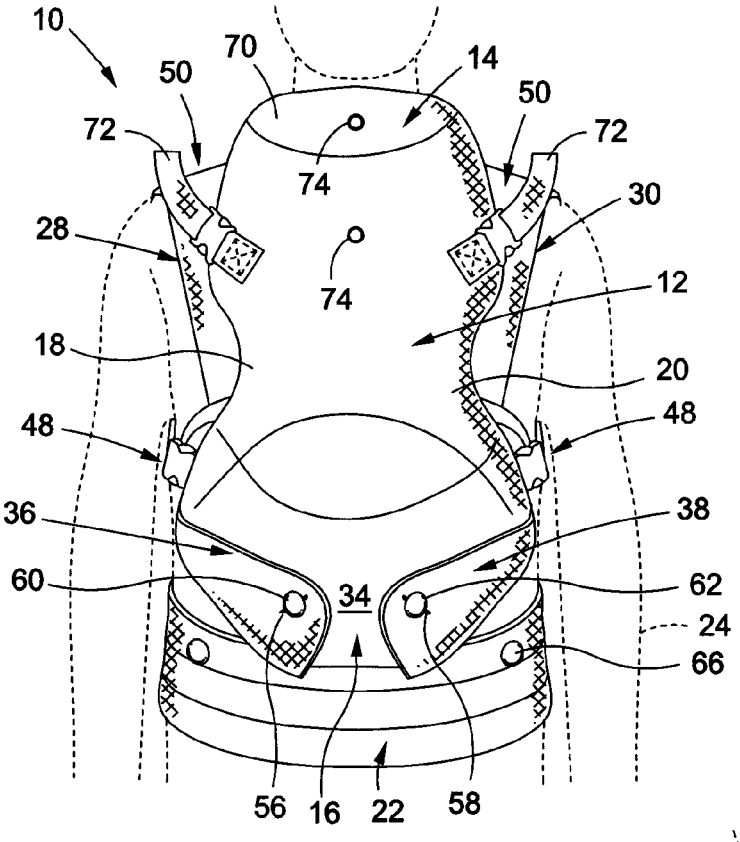
FIG. 1 is a front view of an adjustable infant carrier constructed in accordance with the present invention, the infant carrier being in a front carry, narrow seat configuration.

Referring now to the drawings, wherein the showings are for purposes of illustrating a preferred embodiment of the present invention only, and are not for purposes of limiting the same, there is depicted an adjustable infant carrier 10 constructed in accordance with the present invention. The infant carrier 10 is specifically configured and adapted to allow the infant carrier 10 to be secured to the wearer before the infant is placed within the carrier 10, thereby enhancing the safety associated with donning the carrier 10 and placing the infant within the carrier 10. Furthermore, other implementations of the infant carrier 10 are specifically adapted to provide enhanced adjustability and ease-of-use relative to conventional infant carriers. More specifically, the infant carrier 10 includes an adjustable seat portion which is selectively transitional between a wide seat configuration and a narrow seat configuration so as to accommodate infants/children of differing size. Additional aspects of the infant carrier 10 facilitate simple tightening or loosening of the infant carrier 10 when the infant is supported therein. The infant carrier 10 is additionally configured to be worn in several front carry configurations, as well as a back carry configuration. Therefore, the preferred embodiment of the infant carrier 10 combines several features which enhance the overall adaptability, safety and ease-of-use relative to conventional infant carriers, thereby allowing the infant carrier 10 to be used for children of varying size as well as in different carrying configurations.

Figure 2:
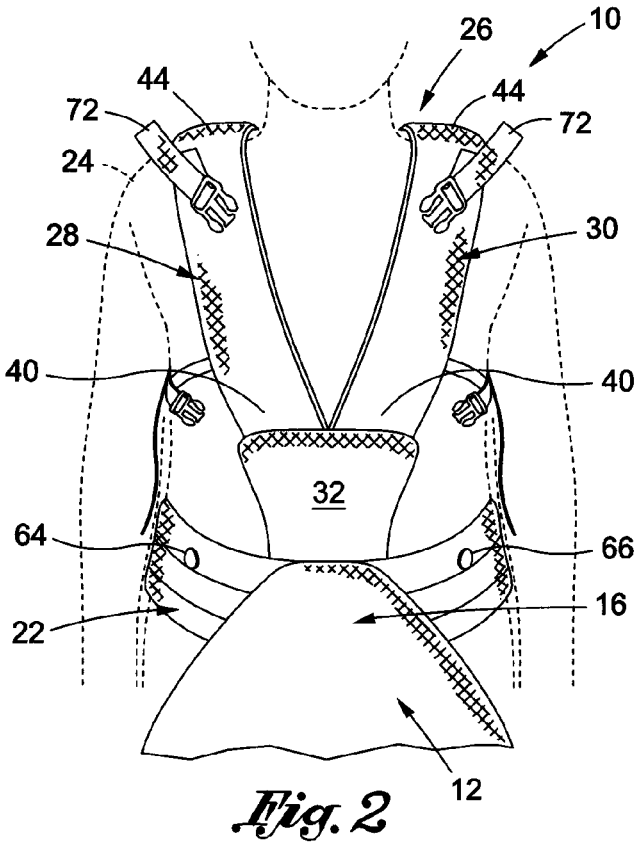
FIG. 2 is a partial front view of the infant carrier depicting a shoulder strap assembly thereof as worn by a wearer (shown in phantom), the carrier body of the carrier being partially shown in a lowered configuration.

Referring now specifically to FIGS. 1 and 2, the infant carrier 10 includes a carrier body 12 having an upper end portion 14, a lower end portion 16 and a pair of opposed side portions 18, 20. The lower end portion 16 of carrier body 12 is connected to a waist belt 22 that is wearable about the midsection/waist of the wearer 24 so as to secure the lower end portion 16 of the carrier body 12 to the wearer 24. The carrier 10 additionally includes a shoulder strap assembly 26 connected to the waist belt 22 and wearable over the wearer's shoulders for supporting the infant carrier 10 on the wearer 24. The shoulder strap assembly 26 generally includes first and second shoulder straps 28, 30, which are connected to the waist belt 22 via a connecting panel 32.

The infant carrier 10 is configured such that the when the carrier 10 is worn by the wearer 24, the infant carrier 10 defines a cavity between the carrier body 12, the connecting panel 32 and the shoulder straps 28, 30 within which the infant may be supported. Along these lines, the lower end portion 16 of the carrier body 12 and the connecting panel 32 collectively define a pair of leg openings through which the infant's legs may extend. Furthermore, the infant's arms may extend between the carrier body 12 and the shoulder straps 28, 30, with the carrier body 12 preferably being contoured to allow for increased range-of-motion for the infant's arms. To that end, the side portions 18, 20 of the exemplary embodiment each have concave shaped contours so as not to substantially inhibit the range-of-motion of the infant's arms. Furthermore, the upper end portion 14 is configured to support the infant's head when the infant is placed in an inward facing configuration, and is also selectively transitional to a folded configuration when the infant is placed in an outward facing configuration, as will be explained in more detail below.

Figure 3:
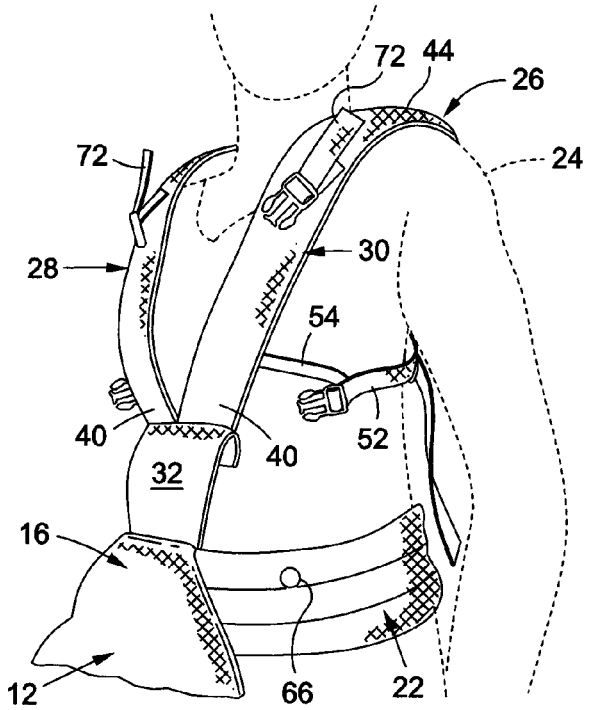
FIG. 3 is a partial perspective view of the infant carrier depicted in FIG. 2.
Figure 4:
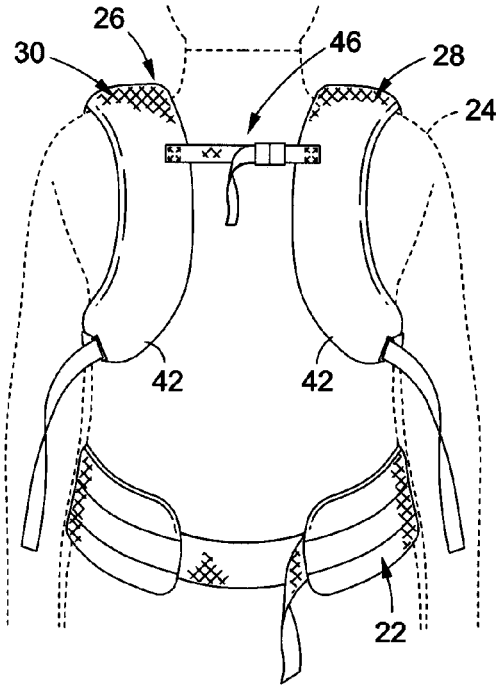
FIG. 4 is a rear view of the wearer and infant carrier depicted in FIG. 1.

Referring now specifically to FIGS. 2-4, the lower end portion 16 of the carrier body 12 is coupled to the waist belt 22 so as to allow the carrier body 12 to be folded over the waist belt 22, which in turn simplifies placement of the infant within the carrier 10, as will be described in more detail below as well. According to one embodiment, the lower end portion 16 includes an intermediate section 34 interposed between a pair of conversion flaps 36, 38 of the lower end portion 16 which is preferably joined to the waist belt 22 via a sewn seam, wherein a portion of the intermediate section 34 overlaps with the waist belt 22 at the seam. The connection between the intermediate section 34 and the waist belt 22 allows the carrier body 12 to be selectively lowered and raised during placement of the carrier 10 on the wearer 24.

The waist belt 22 is additionally coupled to the first and second shoulder straps 28, 30, such that each shoulder strap 28, 30 defines a proximal end portion 40 disposed adjacent the waist belt 22, an opposed free end portion 42, and an intermediate portion 44 between the proximal and free end portions 40, 42. In the exemplary embodiment, the proximal end portions 40 of the shoulder straps 28, 30 are coupled to the connecting panel 32, which in turn, is connected to the waist belt 22, although it is understood that in other embodiments, the proximal end portions 40 may be coupled directly to the waist belt 22, i.e., without the connecting panel 32. The shoulder straps 28, 30 are preferably arranged such that the proximal end portions 40 converge to define a "V" shape, while the intermediate portions 44 are spaced from each other so as to extend on opposed sides of the user's neck and head. The intermediate portions 44 may be connected to each other via an adjustable shoulder strap connector 46, which includes a first segment coupled to the first shoulder strap 28 and a second segment coupled to the second shoulder strap 30. The first and second segments are detachably connected to each other via a buckle or other fastening mechanism.

The infant carrier 10 is specifically configured and adapted to allow the wearer 24 to completely place the shoulder strap assembly 26 on the wearer 24 before the infant is placed in the carrier 10. In this regard the shoulder straps 28, 30 conform to the wearer 24 and do not extend around the infant or the carrier body 12. Furthermore the shoulder straps 28, 30 are not integrated into the carrier body 12; rather, the upper end portion 14 of the carrier body 12 is detachable from the carrier body 12 via a plurality of connectors, which separates the functions of securing the shoulder strap assembly 26 to the wearer 24, and securing the infant within the carrier 10.

In the exemplary embodiment, the infant carrier 10 includes a pair of lower connectors 48 and a pair of upper connectors 50 which are collectively used to secure the carrier body 12 in an upright configuration suitable for supporting the infant. The pair of lower connectors 48 connect the opposed lateral sides portions 18, 20 the carrier body 12 to the free end portions 42 of respective ones the shoulder straps 28, 30, while the upper connectors 50 connect the upper end portion 14 of the carrier body 12 to the intermediate portions 44 of respective ones of the shoulder straps 28, 30. Each connector 48, 50 is preferably comprised of a male connector component and a corresponding female connector component to allow for selective, releasable engagement therebetween.

Each lower connector 48 is connected to a respective adjustment strap 52, which extends from the free end portion 42 of a respective shoulder strap 28, 30 to one of the male and female connector components of the lower connector 48. The lower connector 48 is translatable or moveable along the length of the corresponding adjustment strap 52, which allows the infant carrier 10 to be tightened or loosened by sliding the lower connectors 48 along the adjustment straps 52.

Each adjustment strap 52 is coupled to an elastic strap 54, which extends between the adjustment strap 52 and a respective shoulder strap 28, 30. The elastic strap 54 is stretchable between extended and contracted configurations, although the elastic strap 54 is preferably biased toward the contracted configuration. The biasing of the elastic strap 54 toward the contracted configuration draws the adjustment strap 52 toward the wearer 24 so as to create a snug and comfortable fit on the wearer 24.

Similarly, each upper connector 50 is connected to a respective adjustment strap 72, which extends from the intermediate portion 44 of a respective shoulder strap 28, 30 to one of the male and female connector components of the upper connector 50. The upper connector 50 is translatable or moveable along the length of the corresponding adjustment strap 72, which allows the infant carrier 10 to be tightened or loosened by sliding the upper connectors 50 along the adjustment straps 72.

Figure 5:
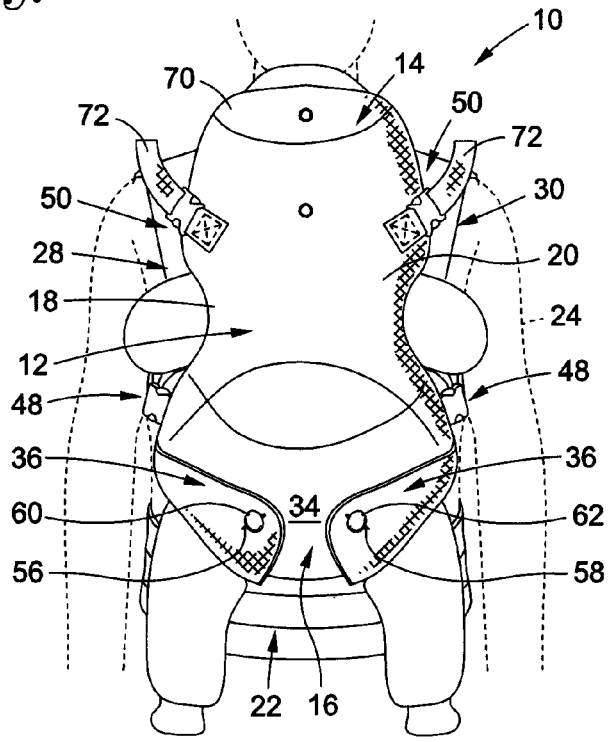
FIG. 5 is a front view of the infant carrier in a front carry, narrow seat, inward facing configuration.
Figure 6:
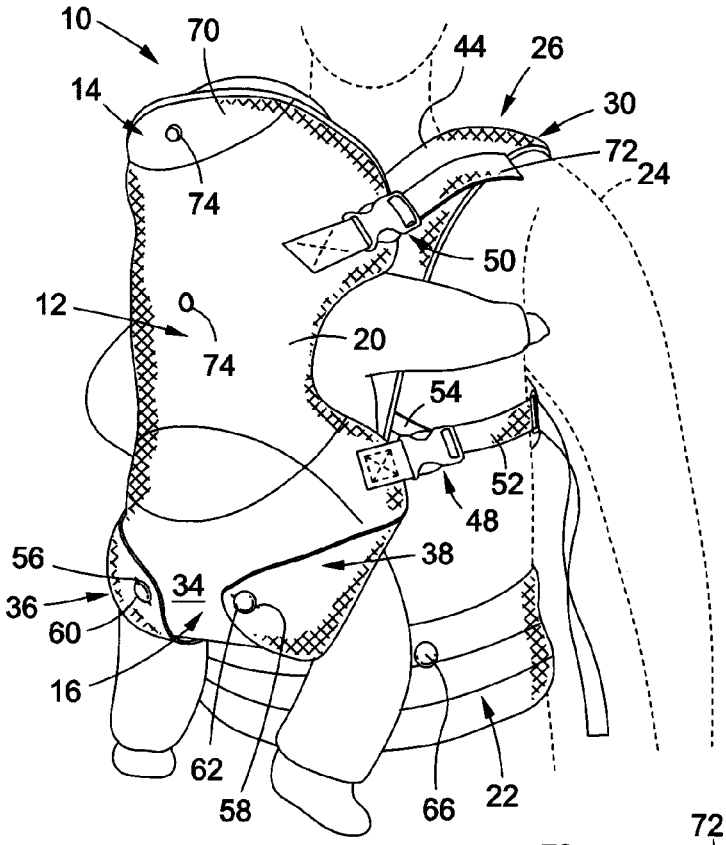
FIG. 6 is a perspective view of the infant carrier depicted in FIG. 5.
Figure 7:
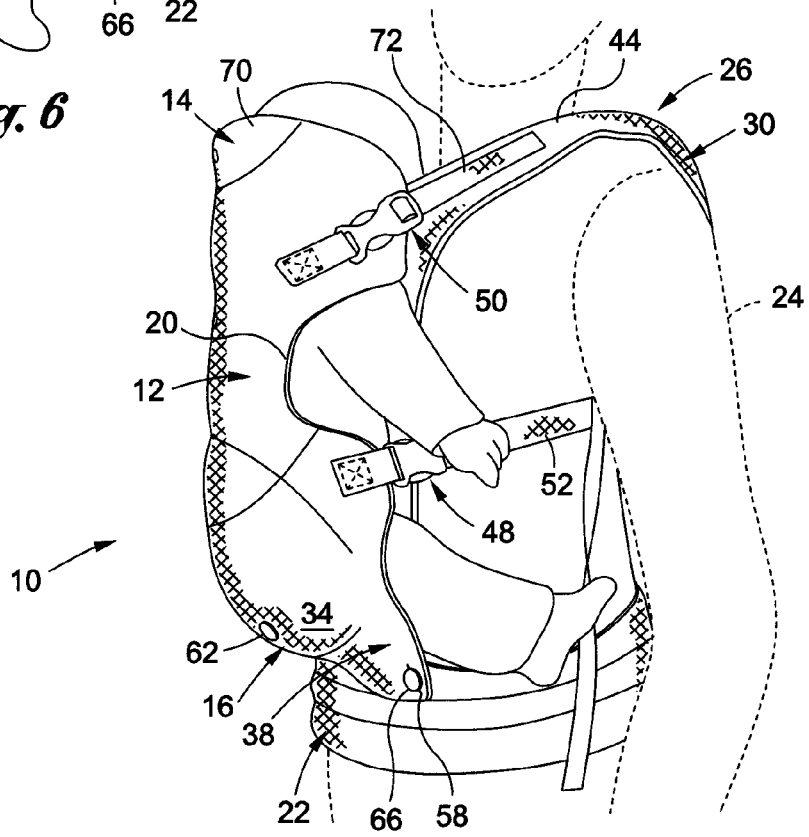
FIG. 7 is a perspective view of the infant carrier in a front carry, wide seat, inward facing configuration.
Figure 8:
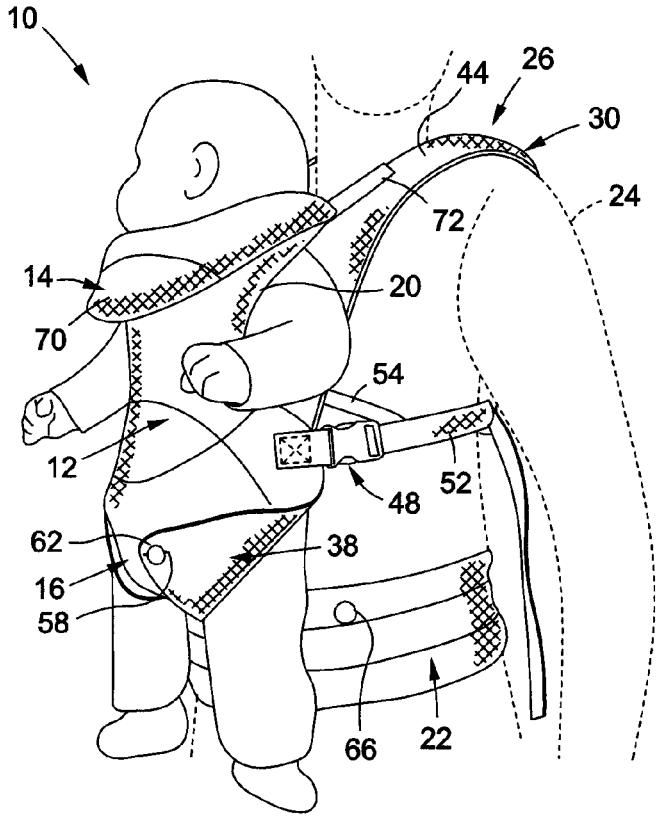
FIG. 8 is a perspective view of the infant carrier in a front carry, narrow seat, outward facing configuration.
Figure 9:
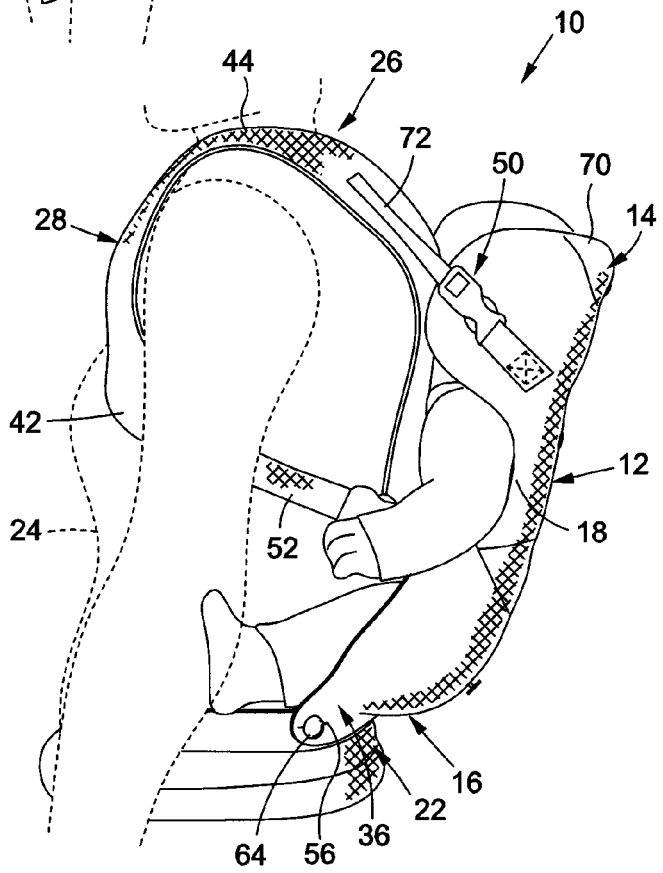
FIG. 9 is a side view of the infant carrier in a back carry configuration.

According to another aspect of the present invention, the infant carrier 10 includes an adjustable seat to allow the carrier body 12 to be selectively transitioned between a narrow seat configuration, as shown in FIGS. 1, 5, 6, and 8, and a wide seat configuration, as shown in FIGS. 7 and 9. As noted above, the infant carrier 10 includes a pair of conversion flaps 36, 38 disposed on opposed sides of the intermediate section 34 of the carrier body 12. The conversion flaps 36, 38 are preferably integral to the carrier body 16 and each conversation flap 36, 38 is separately and selectively foldable relative to the intermediate section 34 to accommodate the transition between the narrow seat and wide seat configuration.

In the exemplary embodiment depicted in the figures, each conversion flap 36, 38 includes a flap fastener/slot 56, 58 that is sized and configured to receive a button for maintaining the conversion flap 36, 38 in the narrow or wide configuration. Along these lines, the infant carrier 10 includes a pair of narrowing fasteners/buttons 60, 62 coupled to the outer surface of the intermediate section 34 of the carrier body 10, and a pair of widening fasteners/buttons 64, 66 coupled to the waist belt 22. The narrowing buttons 60, 62 are advanced through respective ones of the slots 56, 58 to maintain the conversion flaps 36, 38 in the narrow configuration, while the widening buttons 64, 66 are advanced through respective ones of the slots 56, 58 to maintain the conversion flaps 36, 38 in the wide configuration.

The use of slots 56, 58 and buttons 60, 62, 64, 66 for securing the conversion flaps 36, 38 in either the narrow or wide configurations allows the wearer 24 to effectuate such conversion using only one hand. Therefore, if the conversion flaps 36, 38 need to be adjusted after the wearer 24 has placed the infant carrier 10 on his/her shoulders, the wearer 24 may easily reach for the button and corresponding conversion flap 36, 38 for placing the conversion flap 36, 38 in the desired configuration.

When the conversion flaps 36, 38 are in the narrow configuration, the conversion flaps 36, 38 overlap with a portion of the intermediate section 34 of the lower end portion 16 of the carrier body 12. In contrast, when the conversion flaps 36, 38 are in the wide configuration, the conversion flaps 36, 38 extend outwardly from the intermediate section 34, such that the degree of overlap between the conversion flaps 36, 38 and the intermediate section 34 decreases as the conversion flaps 36, 38 transition from the narrow configuration to the wide configuration.

Although the exemplary embodiment utilizes slots 56, 58 and corresponding buttons 60, 62, 64, 66 for maintaining the conversion flaps 36, 38 in the narrow configuration or wide configuration, it is understood that other mechanical fasteners, such as hook and loop fasteners, snaps, clasps or other fasteners known in the art may be used without departing from the spirit and scope of the present invention.

With the basic structure of the infant carrier 10 described above, the following will discuss use of the infant carrier 10 in a variety of different configurations. According to one embodiment, the infant carrier 10 is configured to be worn in three front carry configurations (i.e., with the infant carried in front of the wearer's chest) and a rear carry configuration (i.e., with the infant carried over the wearer's back).

When the infant carrier 10 is worn in one of the front carry configurations, the shoulder strap assembly 26 is placed over the wearer's shoulders in a manner shown in FIGS. 2-4. In particular, both shoulder straps 28, 30 are placed over respective ones of the wearer's shoulders before the infant is placed in the carrier 10. The lower connectors 48 may be adjusted on the adjustment straps 52 to size the carrier 10 to the wearer 24. In addition, the wearer 24 connects the shoulder strap connector 46, which extends over the wearer's back.

While the wearer 24 is securing the shoulder strap assembly 28 to the wearer's shoulders, the carrier body 12 may be lowered so as to extend downwardly over the user's legs and hang from the waist belt 22. When the carrier body 12 is in the lowered position, the carrier body 12 overlaps a portion of the waist belt 22.

When the shoulder straps 28 are secured to the wearer 24, the wearer 24 may raise the carrier body 12 and connect one of the lower connectors 48, such that one side of the carrier body 12 is attached to the respective shoulder strap 28, 30. By raising the carrier body 12 and connecting the lower connector 48, the carrier body 12 will assist in supporting the infant when the infant is placed in the carrier 10. When the infant carrier 10 is in this configuration, the infant may be placed within the carrier 10 in any of the three front carry configurations.

A first front carry configuration is an inward facing, narrow seat configuration, which is depicted in FIGS. 1, 5, and 6. In this configuration, the conversion flaps 36, 38 may be placed in the narrow configuration prior to placing the infant within the carrier 10. In particular, the narrowing buttons 60, 62 may be advanced through the respective slots 56, 58 formed on the conversion flaps 36, 38. The infant is then placed in the carrier 10 such that the infant is facing inwardly toward the wearer 24 and the infant's legs straddle legs extend on opposed sides of the intermediate section 34 of the lower end portion 16 of the carrier body 12. With the infant in place and the wearer 24 continuing to support the infant, the remaining lower connector 48 is connected, thereby securing both sides of the carrier body 12 to the respective shoulder straps 28, 30. Subsequently, the upper connectors 50 are connected on both sides of the carrier body 10 to secure the upper end portion 14 of the carrier body 12 to the shoulder straps 28, 30. The upper end portion 14 includes a head support panel 70 that extends behind the infant's head to provide support thereto. The head support panel 70 is in a raised, unfolded configuration when the infant carrier is in the front carry, inward facing configuration.

When the infant is seated within the carrier 10, the adjustable straps may be adjusted to provide a more comfortable fit. For instance, when the adjustment straps 52 are drawn in, the carrier body 12 is drawn toward the wearer 24, which in turn, draws the infant toward the wearer 24 to provide a safe and secure support for the infant. Furthermore, the straps 72 may be used to adjust the upper connectors 50 to a desired position.

The narrow seat, inward facing configuration may be particularly desirable for carrying small babies, since the infant carrier 10 provides a smaller seat to accommodate the small size of the infant, and also provides support to the infant's head via the head support panel 70.

A second forward support configuration is a wide seat, inward facing configuration (See FIG. 7), which is identical to the narrow seat, inward facing configuration described above, with the primary distinction being that the conversion flaps 36, 38 are placed in the wide seat configuration prior to placing the infant within the carrier 10. In this regard the widening buttons 64, 66 are advanced through the slots 56, 58 in the conversion flaps 36, 38. The wide seat, inward facing configuration may be desirable for older babies and provide a more ergonomic seated position for those babies.

A third forward support configuration is a narrow seat, outward facing configuration, which is shown in FIG. 8. In this configuration, the seat portion of the carrier body 10 is placed in the narrow seat configuration, as described above (i.e., the narrowing buttons 60, 62 are advanced through the slots 56, 58 formed on the conversion flaps 36, 38). The infant is then placed in the carrier 10 with the infant facing away from the wearer 24, such that the infant's legs straddle the lower end portion 16 of the carrier body 12. With the wearer 24 supporting the infant with one arm, the wearer 24 secures the remaining lower connector 48. The upper end portion 14 of the carrier body 12 is raised over the infant's chest and the upper connectors 50 are connected.

The head support panel 70 is folded so as to overlap with a portion of the carrier body 12 and to move away from the infant's face. Thus, when the infant is seated in the outward facing position, the infant can view what is happening in front of the infant. The infant carrier 10 may include a complementary head support fasteners 74, such as snaps, buttons, hook and loop fasteners, magnets, or the like for securing the head support panel 74 in the folded configuration.

As noted above, and referring now specifically to FIG. 9, the infant carrier 10 is additionally configured to be worn in a back carry configuration, wherein the carrier body 12 is worn over the wearer's back. When placing the carrier 10 in the back carry configuration, the conversion flaps 36, 38 are preferably adjusted prior to placing the shoulder straps 28, 30 on the wearer 24. In particular, the conversion flaps 28, 30 are preferably placed in the wide configuration, as described above, to provide support the child's bottom and legs, and to guide the child's legs around the wearer's back. One of the lower connectors 48 is preferably connected so as to maintain the carrier body 12 in a generally upright configuration (i.e., wherein the carrier body 12 is not overlapping with the waist belt 22).

The shoulder straps 28, 30 are then placed on the wearer in a reverse fashion compared to the front carry configurations discussed above. In particular, the free end portions 54 of the shoulder straps 28, 30 are placed over the wearer's chest, rather than over the wearer's back, as is the case in the front carry configuration.

With the shoulder straps 28, 30 secured, the infant is placed in the carrier 10. The infant's arm extends over the connected lower connector 48 and the infant's legs straddle the connecting panel 32 and extend on opposed sides of the wearer's back. The remaining lower connector 48 is connected and extends under the infant's arm. The upper end portion 14 of the carrier body 12 extends behind the infant's head to provide support thereto. In this regard, the head support panel 70 is extended into its upright, unfolded configuration. The upper connectors 50 are connected to secure the upper end portion 14 to the shoulder straps 28, 30.

Although the foregoing describes placement of the conversion flaps 36, 38 in one of the narrow or wide configurations prior to placing the shoulder straps 28, 30 on the wearer, it is also understood that the wearer 24 may transition he conversion flaps 36, 38 between the narrow and wide configurations after the shoulder straps 28, 30 have been placed on the wearer 24.

This disclosure provides exemplary embodiments of the present invention. The scope of the present invention is not limited by these exemplary embodiments. Numerous variations, whether explicitly provided for by the specification or implied by the specification, such as variations in structure, dimension, type of material and manufacturing process may be implemented by one of skill in the art in view of this disclosure.

What is claimed is:

1. An adjustable infant carrier wearable by a user for carrying an infant, the infant carrier comprising:

a waist belt disposable about the waist of the wearer;

a connecting panel coupled to, and extending from, the waist belt;

a pair of shoulder straps each having a proximal end portion and an opposed free end portion and a middle section disposed between the proximal end portion and the free end portion, the proximal end portion of each should strap being separated from the waist belt by the connecting panel, which is located between the proximal end portion of each shoulder strap and the waist belt;

a pair of adjustment straps, each adjustment strap extending from the free end portion of a respective one of the shoulder straps;

a pair of elastic straps, each elastic strap extending between a respective one of the adjustment straps and the middle section of a corresponding one of the shoulder straps, such that a pair of closed loops are completely and collectively defined by respective ones of the shoulder straps, adjustment straps and elastic straps; and a carrier body coupled to the waist belt and connectable to the shoulder straps, the carrier body having a middle section and a pair of conversion flaps disposed on opposed sides of the middle section, each conversion flap being selectively transitional between a narrow configuration, wherein a free end portion of the conversion flap is connected to the middle section, and a wide configuration, wherein the free end portion of the conversion flap is connected to the waist belt.

2. The adjustable infant carrier of claim 1, further comprising:

a pair of carrier body buttons coupled to the carrier body;

a pair of waist belt buttons coupled to the waist belt; and a pair of slots formed in respective ones of the pair of conversion flaps;

the pair of slots being configured to receive respective ones of the pair of carrier body buttons when the conversion flaps are in the narrow configuration;

the pair of slots being configured to receive respective ones of the pair of waist belt buttons when the conversion flaps are in the wide configuration.

3. The adjustable infant carrier of claim 1, wherein the carrier body is pivotally coupled to the waist belt and transitional between an upper configuration and a lower configuration relative to the waist belt when the waist belt and shoulder straps are worn by the wearer, the degree of overlap between the carrier body and waist belt increasing as the carrier body transitions from the upper configuration to the lower configuration.

4. The adjustable infant carrier of claim 1, further comprising a pair of connectors coupled to respective ones of the shoulder straps and the carrier body for selectively connecting the shoulder straps to the carrier body.

5. The adjustable infant carrier of claim 4, wherein each connector includes a male connector component and a corresponding female connector component which is releasably engageable to the male connector component.

6. The adjustable infant carrier of claim 1, wherein the infant carrier is configured to be wearable in any one of three discrete front carry configurations, wherein the infant is supported over the wearer's chest and a back carry configuration, wherein the infant is supported over the wearer's back.

7. The adjustable infant carrier of claim 6, wherein the carrier body includes a main portion and an upper portion foldable relative to the main portion between an inward facing configuration and an outward facing configuration, the upper portion being folded over the main portion to at least partially overlap the main portion when the upper portion is in the outward facing configuration.

8. The adjustable infant carrier of claim 7, wherein the front carry configurations include:

a first configuration wherein the conversion flaps are in the narrow configuration and the carrier body is in the inward facing configuration;

a second configuration wherein the conversion flaps are in the narrow configuration and the carrier body is in the outward facing position; and a third configuration wherein the conversion flaps are in the wide configuration and the carrier body is in the inward facing position.

9. An adjustable infant carrier wearable by a user for carrying an infant, the infant carrier comprising:

a pair of shoulder straps;

a pair of adjustment straps, each adjustment strap being coupled to and extending from a respective one of the shoulder straps;

a pair of loop straps, each loop strap extending between a respective one of the shoulder straps and a respective one of the adjustment straps such that a pair of closed loops are completely and collectively defined by respective ones of the shoulder straps, the adjustment straps, and the loop straps; and a carrier body connectable to the shoulder straps, the carrier body having a middle section and a pair of conversion flaps disposed on opposed sides of the middle section, each conversion flap being selectively transitional between a narrow configuration and a wide configuration, the degree of overlap between the conversion flap and the middle section decreasing as the conversion flap transitions from the narrow configuration toward the wide configuration.

10. The adjustable infant carrier of claim 9, wherein:

each shoulder strap includes a proximal end portion and a distal end portion;

each adjustment strap extends from the distal end portion of the respective one of the shoulder straps;

each loop strap extends from the respective one of the adjustment straps and the proximal end portion of the respective one of the shoulder straps.

11. The adjustable infant carrier of claim 9, wherein each loop strap is elastic and extends along an axis so as to be axially stretchable along the axis between an extended configuration and a contracted configuration, each loop strap being biased toward the contracted configuration.

12. The adjustable infant carrier of claim 9, wherein the infant carrier is configured to be wearable in any one of three discrete front carry configurations, wherein the infant is supported over the wearer's chest and a back carry configuration, wherein the infant is supported over the wearer's back.

13. The adjustable infant carrier of claim 12, wherein the carrier body includes a main portion and an upper portion foldable relative to the main portion between an inward facing configuration and an outward facing configuration, the upper portion being folded over the main portion to at least partially overlap the main portion when the upper portion is in the outward facing configuration.

14. The adjustable infant carrier of claim 13, wherein the front carry configurations include:

a first configuration wherein the conversion flaps are in the narrow configuration and the carrier body is in the inward facing configuration;

a second configuration wherein the conversion flaps are in the narrow configuration and the carrier body is in the outward facing position; and a third configuration wherein the conversion flaps are in the wide configuration and the carrier body is in the inward facing position.

15. The adjustable infant carrier of claim 9, further comprising a waist belt coupled to the carrier body.

16. The adjustable infant carrier of claim 15, wherein the carrier body is pivotally coupled to the waist belt and transitional between an upper configuration and a lower configuration relative to the waist belt when the waist belt and shoulder straps are worn by the wearer, the degree of overlap between the carrier body and waist belt increasing as the carrier body transitions from the upper configuration to the lower configuration.

17. The adjustable infant carrier of claim 15, further comprising:

a pair of carrier body fasteners coupled to the carrier body;

a pair of waist belt fasteners coupled to the waist belt; and a pair of flap fasteners disposed on respective ones of the pair of conversion flaps;

the pair of flap fasteners being configured to engage with respective ones of the pair of carrier body fasteners when the conversion flaps are in the narrow configuration;

the pair of flap fasteners being configured to engage with respective ones of the pair of waist belt fasteners when the conversion flaps are in the wide configuration.

18. The adjustable infant carrier of claim 17, wherein:

the pair of carrier body fasteners includes a pair of carrier body buttons;

the pair of waist belt fasteners includes a pair of waist belt buttons;

the pair of flap fasteners includes a pair of slots;

the pair of slots being configured to receive respective ones of the carrier body buttons when the conversion flaps are in the narrow configuration;

the pair of slots being configured to receive respective ones of the waist belt buttons when the conversion flaps are in the wide configuration.

* * * * *